US007312773B1

(12) United States Patent
Herzen et al.

(10) Patent No.: US 7,312,773 B1
(45) Date of Patent: Dec. 25, 2007

(54) ILLUMINATED WEARABLE ORNAMENT

(75) Inventors: Brian Von Herzen, Stateline, NV (US); David C. Keenan, Bardon (AU)

(73) Assignee: Rapid Prototypes, Inc., Stateline, NV (US)

( * ) Notice: Subject to any disclaimer, the term of this patent is extended or adjusted under 35 U.S.C. 154(b) by 0 days.

(21) Appl. No.: 09/351,420

(22) Filed: Jul. 9, 1999

(51) Int. Cl.
*G09G 3/32* (2006.01)

(52) U.S. Cl. ..... 345/82; 345/39; 345/55; 362/104

(58) Field of Classification Search ..... 345/473–474, 345/33–34, 39, 55, 82, 685–686, 830, 204, 345/211–213, 107; 362/104–108
See application file for complete search history.

(56) References Cited

U.S. PATENT DOCUMENTS

| | | | | | |
|---|---|---|---|---|---|
| 4,254,451 | A | | 3/1981 | Cochran, Jr. | 362/103 |
| 4,303,996 | A | | 12/1981 | Schmitz | 368/82 |
| 4,345,308 | A | * | 8/1982 | Mouyard et al. | 362/332 |
| 4,398,819 | A | | 8/1983 | Schron | 355/14 R |
| 4,602,191 | A | * | 7/1986 | Davila | 315/76 |
| 4,637,148 | A | * | 1/1987 | Barlow | 401/1.5 |
| 4,777,408 | A | | 10/1988 | DeLuca | 315/158 |
| 5,330,062 | A | * | 7/1994 | Murphree | 211/122 |
| 5,375,044 | A | | 12/1994 | Guritz | 362/104 |
| 5,544,027 | A | * | 8/1996 | Orsano | 362/105 |
| 5,575,554 | A | | 11/1996 | Guritz | 362/103 |
| 6,028,597 | A | * | 2/2000 | Ryan, Jr. et al. | 345/211 |
| 6,118,426 | A | * | 9/2000 | Albert et al. | 345/107 |
| 6,143,381 | A | * | 11/2000 | Hawkins | 428/7 |
| 6,201,525 | B1 | * | 3/2001 | Janney | 345/124 |
| 6,208,078 | B1 | * | 3/2001 | Fujii et al. | 313/510 |
| 6,314,669 | B1 | * | 11/2001 | Tucker | 40/448 |
| 6,331,861 | B1 | * | 12/2001 | Gever et al. | 345/629 |
| 6,369,793 | B1 | * | 4/2002 | Parker | 345/107 |

OTHER PUBLICATIONS

"Flash Banner," two pages from catalogue by Tiger Electronics, Inc. (1998).
"REX-3," by Franklin Electronic Publishers, www.franklin.com/rex/rex3.html, downloaded Jul. 7, 1999.
"AVR ISP," fifteen page application note by Atmel Corporation, ftp://www.atmel.com/pub/atmel/avr910.asm, downloaded Jul. 9, 1999.

(Continued)

*Primary Examiner*—Richard Hjerpe
*Assistant Examiner*—Kimnhung Nguyen
(74) *Attorney, Agent, or Firm*—Louis J. Hoffman

(57) ABSTRACT

An electronic ornament that can be worn or attached to or suspended from an object has an LED matrix (21) capable of displaying a user-selected message from a preprogrammed set of graphic symbols or a user-programmed arbitrary pattern or animation. A safety pin (31) or other fastener (34) attaches the ornament to a wearer or to an object, making the display readable by others during conversations and gatherings from a distance of several meters. The user can select the message or pattern using only two buttons (28) and (29), and the selection is retained even when battery (25) is removed. The LED display (21) scrolls messages horizontally such that more than one average text character but less than one average word is visible at a time, making the display surprisingly readable yet economical and small enough to make it easy to wear or use as a lightweight ornament.

71 Claims, 13 Drawing Sheets

OTHER PUBLICATIONS

Atmel Corporation, "Software & Shareware," seven pages; http://www.atmel.com/atmel/products/prod180htm, downloaded Jul. 9, 1999.

"AVR910: In-System Programming," nine page application note by Atmel Corporation, http://www.atmel.com/atmel/acrobat/doc0943.pdf, downloaded Jul. 9, 1999.

* cited by examiner

```
:100000004AC0A4C0FF27FA95F1F70895E6E0D08131
:10001000F083FD2FEA95DAF70895E7E0E05FF081DD
:10002000E151F083D9F70895E199FECFFEBAE09A45
:10003000FDB3FF3F09F4F0E00895E199FECFFEBA69
:10004000FDBBE19A089598E0EE27F1E0DF2EE08015
:10005000919AA1E0FE2DFA2339F017D0FFE7DF26B1
:10006000D8BADF26F3E102C010D0F5E10EF0CBDF05
:100070009098919 8AA0FA03269F7E395DD0CE730CC
:1000800030F39A9509F7C69A0895FFE7F8BB909A5E
:10009000DEF7F3E1B8CFF5E0F3BFF0E3F5BFF0E44E
:1000A000FBBFFFEFF7BBFFE7F8BBF3E0F1BBFCE4FE
:1000B000F2BBCFEFF1E07BD0B0DFFF24B5DF77D02C
:1000C000B1E10F5EF894CC2321F478948895F894EC
:1000D000F1CFCC2352F4B01798F598DFEB2FF081D5
:1000E000B395E6E0F083F5FDF6CFA1FC02C083995D
:1000F00024C0F2ECF2BFF8BFBB2484DF7894C13097
:1001000021F4F8B7AF2AF1FD04C0839BF8CFBA28D9
:10011000AA24F89477DFF6F9FC27F6FBC13069F4DE
:10012000BB2059F481DFFF3221F0FF3711F0F39546
:1001300001C0F07482DF3AD070DF85DF7894C2CFDF
:10014000CA9472DFFF2321F2F394B8CF5BDFBB24A4
:10015000839903C0FFEFBF2E02C0829901C0F8CF80
:1001600051DFCC2311F4CFEF20C07AF4C0E0F8B710
:10017000F1FF04C0B0FE19C0FA9401C0FC0CC1E04C
:10018000CC2E52DF13D049DF10C0F7E4F2BFF8BF26
:10019000CFEFB0FE0AC0C1E047DFFF3608F0FFE650
:1001A000D0E4FD274ADF02D038DF1895F0681FE160
:1001B00021E10027E3E10083E395E931E0F3F6FF75
:1001C00007C01F2F222771E0F5FD61E001E016C195
:1001D000F5FDA2C0F4FD57C0F3FD35C0F2FD23C00C
:1001E000F1FD14C0F03009F409C11127222708E0FD
:1001F000F0FD06C014E02EE035E144E057E0FAC01F
:10020000F7FFF8C014E034E054E0F4C0F0FD08C09B
:10021000222701E0F7FD02C01127ECC014E0EAC07C
:100220001EE125E0DCC0F1FD07C0F0FD04C025E1C2
:1002300035E14AE0DAC0D1C0F0FD02C03EE0D2C0F4
:1002400025E135E1CAC0F2FD0EC0F1FD07C0F0FDA9
:1002500003C025E035E0C1C03DE1C4C0F0FD02C0EF
```

FIG. 9A

```
:1002600024E0BDC0B7C0F1FD07C0F0FD02C018E139
:10027000B8C02AE031E1B6C0F0FD02C020E1ADC057
:1002800022E034E0B4C0F3FD21C0F2FD10C0F1FD66
:1002900006C0F0FD03C022E034E0A6C0A0C0F0FD1F
:1002A00003C025E037E09EC01FE029E09AC0F1FDC1
:1002B00006C0F0FD03C02DE037E194C03FC0F0FD63
:1002C00003C011E02FE18BC020E189C0F2FD12C014
:1002D000F1FD08C0F0FD03C017E028E180C028E070
:1002E00034E085C0F0FD03C01BE124E078C013E0DA
:1002F0002CE175C0F1FD07C0F0FD04C019E125E156
:1003000033E170C06CC0F0FD03C010E020E069C0B4
:100310001DE125E137E166C0F4FD5BC0F3FD2CC0B3
:10032000F2FD13C0F1FD08C0F0FD03C015E125E1A9
:1003300058C017E024E055C0F0FD04C017E125E1E6
:100340003DE150C025E13DE14DC0F1FD07C0F0FDAC
:1003500003C011E021E045C025E141C0F0FD03C02C
:1003600017E125E13EC016E029E039E042E159E01D
:1003700069E076E008E03EC0F2FD10C0F1FD06C085
:10038000F0FD02C010E126C017E124C0F0FD04C05A
:1003900011E025E137E026C013E01CC0F1FD0CC0E0
:1003A000F0FD03C01EE035E01FC012E125E13FE192
:1003B00045E159E006E01EC0F0FD04C018E124E06C
:1003C00033E010C014E024E03FE144E054E006E0F4
:1003D00011C014C0222702E00DC0322F03C0312FFC
:1003E00001C03FE104E006C0412F05E003C0512FEA
:1003F000422F06E00F5F083008F008E0FF7708950D
:00000001FF
```

FIG. 9B

```
:100000000F0714141B021A0F031502484E5F4E48C7
:10001000404040444040406060646E6460406064C2
:10002000647B6464406464607160644464606060C4
:0B00300060604460606060604001 40
:00000001FF
```

FIG. 10

ILLUMINATED WEARABLE ORNAMENT

COPYRIGHT STATEMENT

The printed circuit layout in FIG. 4 and the computer source code in FIGS. 9A, 9B, and 10 are subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates to electronic ornaments, specifically to electronic jewelry or ornaments that can display character-based messages and non-character symbols, graphics, animations, and other visual patterns.

BACKGROUND OF THE INVENTION

The use of LED's for light-emitting displays on a variety of objects is well known.

Rectangular matrices of LED's with appropriate control circuitry, to display scrolling messages of any length, including symbols, graphics, and animated images, are often seen in public places (one famous example is in Times Square in New York City) displaying advertising or news messages by scrolling them across the width of the display. These are not suitable for use as jewelry, ornaments, or items of apparel, because they are too large and heavy, would not operate for long enough on a small enough battery, or are too expensive to manufacture.

It has long been recognized in the art that a longer display is advantageous in promoting readability. For example, U.S. Pat. No. 4,398,819, which is hereby incorporated by reference, discusses near the end of column 1 the difficulty in understanding a lengthy message when displayed in a "continuously rotating" format on a display, in that case on a photocopier control panel.

U.S. Pat. No. 5,767,822 discloses a way to reduce the number of LED's in a scrolling display, but this reference fails to suggest reducing the width or height of the display, as measured in pixels.

In some instances, such as U.S. Pat. Nos. 5,375,044, 5,575,554, 4,777,408, 4,254,451, which are hereby incorporated by reference, inventors have disclosed light-emitting displays on wearable items. Some provide a choice between a few different sequences of flashing pulses, but none allow a user to create a personal message, graphic, or animated image.

U.S. Pat. No. 4,303,996 discloses an LED watch that is capable of displaying up to five alphanumeric words of five characters each. The words are displayed sequentially using a linear array of five nine-segment displays, and there is no teaching of scrolling the words. The watch cannot display messages of more than five words or words of more than five characters. It cannot display graphics or animations. The display is not suited for use as a brooch, badge, or tiepin, as is the instant invention, so that people other than the wearer can read the message.

Personal digital assistants or organizers have been available for some time. One example, the Rolodex REX from Franklin is a credit-card-sized device weighing approximately 39 grams and fitting within a rectangular solid of volume approximately 29 milliliters and retailing for approximately US$99. It is powered from two CR2025 lithium coin cells, said to last up to six months in normal use. It uses an LCD display. It has five buttons and a PCMCIA connector. It does not have any means of attachment to a wearer. Its display is 160 pixels wide by 98 high, making it much more expensive than the present invention.

Absent from the prior art, however, is any indication of the use of a shorter display for scrolled characters or animations that has satisfactory readability yet low cost and weight, making it suitable for wearing.

The prior art does not recognize the tradeoff between readability and economy of a scrolling display.

Accordingly, a first object of the invention is to reduce, rather than to increase, the number of pixels, and therefore characters of text, in the width of a display, to minimize the size, weight, frequency of battery changes or battery size, and cost of manufacture, while still being able to display a full set of Arabic digits, Roman letters, and many other symbols, graphics, and animations.

Another object of the invention is to achieve a legible display while retaining the economy of few pixels.

Another object of the invention is to provide an ornament that (1) can display scrolling messages with a length limited only by the available memory in the control circuit (64 characters in a preferred embodiment), (2) that is wearable as a badge, brooch, or tiepin, or that can be included in a greeting card or novelty gift or used as a Christmas ornament or other ornament, and (3) that can display symbols, graphics, and animated images.

Another object of the invention is to provide a control system that retains flexibility yet has low cost and ease of programming.

Another object of the invention is to increase the display-control and message-editing functions available from just two buttons, allowing great functionality with reasonable convenience while keeping the number of buttons and hence cost and size to a minimum.

Another object of the invention is to provide a low-cost device that omits components commonly required in display devices, such as resistors and even an on-off switch.

Further objects and advantages of our invention will become apparent from a consideration of the drawings and ensuing description.

SUMMARY OF THE INVENTION

The inventive system achieves the above objects, and other objects of the invention as may be apparent from review of the detailed description below, by providing apparatus and methods employing an array of display elements or pixels, such as LED's.

When measured in the number of characters of text visible at any time, the inventive apparatus has a width greater than one average-sized character but less than an average word (assumed to equal five characters). In this range of sizes, the viewer can observe an entire character as it scrolls across the screen, thereby providing satisfactory readability, while the goal of an economic device is retained by displaying only a few characters at a time.

Further, the inventive system includes a control circuit capable of causing the array to display alphanumeric characters, symbols, graphics, or animated images. User programming is enabled in a preferred embodiment with two pushbutton switches and a programming connector. The user (1) pushes two buttons simultaneously to select a character for editing purposes as the character scrolls across the display, (2) double-clicks a button to step to the next character in a message, and (3) presses two buttons simultaneously to switch between alternative character sets when editing a character. These controls allow a broad range of functionality while keeping the number of buttons, and hence cost, to a minimum.

This novel approach allows reductions in size, weight, cost of manufacture, and power, with the consequence of either lessening the frequency of battery changes or decreasing the size of the battery.

The inventive system includes a pin or other fastener suitable for attachment to a wearer, the wearer's clothing, or to another object.

Other aspects of the invention will be appreciated by those skilled in the art after a reading of the detailed disclosure of the present invention below.

BRIEF DESCRIPTION OF THE DRAWINGS

FIGS. 9A and 9B contain a program in Intel hex format containing control software for the microcontroller of the apparatus of FIGS. 1-5 and 8 to cause it to perform as in connection with FIGS. 6 and 7.

FIG. 10 includes data in the same format containing a sample message.

Common numerals are used in the several figures to indicate similar elements.

DETAILED DESCRIPTION

Figure 1:
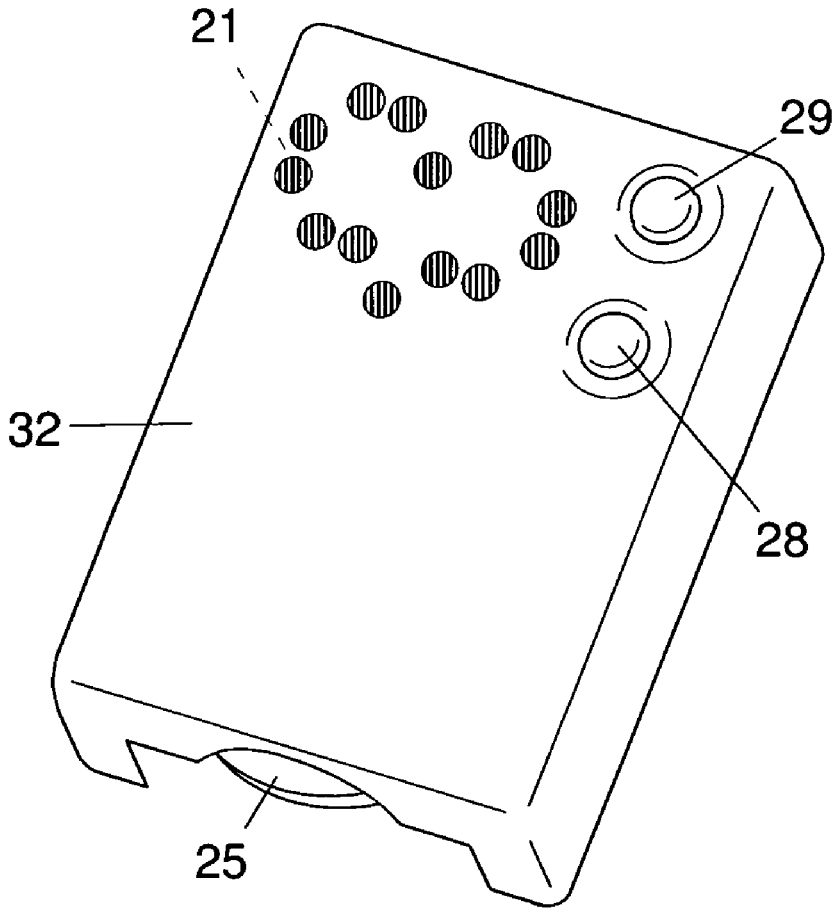
FIG. 1 is a front perspective view of a preferred embodiment of the invention.
Figure 2:
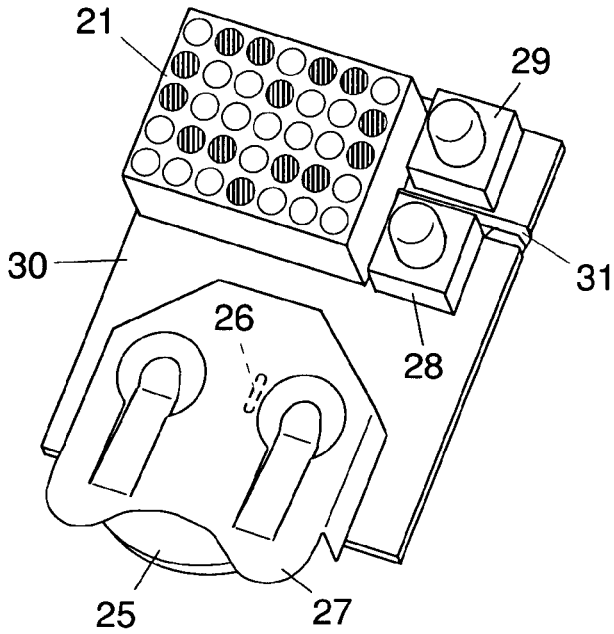
FIG. 2 is a front perspective view of the embodiment of FIG. 1 without the cover.
Figure 3:
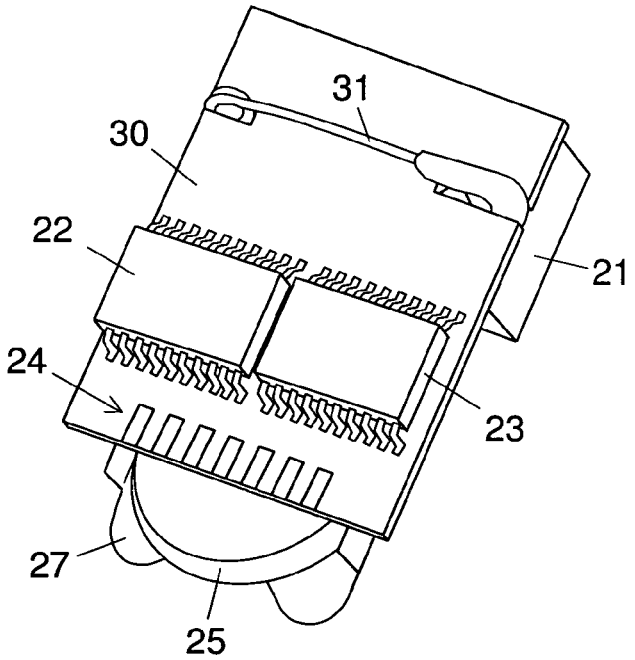
FIG. 3 is a rear perspective view of the embodiment of FIG. 1 without the cover.

FIGS. 1-3 show, from different perspectives, a preferred embodiment of a device formed in accordance with the inventive systems, suitable for wearing as an illuminated ornament, as decorative jewelry or to advertise a message.

In that embodiment, the display is formed of an array of LED's in a matrix 21. The control circuit consists of a printed circuit board (PCB) 30, a microcontroller IC (MCU) 22 and an octal D flip-flop IC 23, both supported on the rear surface of PCB 30. The front surface of PCB 30 supports a wire link 26, a battery holder 27 for the compact power source battery 25, mode button 28 and value button 29, and programming connector 24, formed from some of the conducting tracks on PCB 30 and having seven edge fingers spaced at 2.54 mm centers. The device can be attached to clothing by safety pin 31, attached to the rear.

The components on the front surface of PCB 30 are supported by through-hole-soldering, and the components on the rear surface are supported by surface-mount soldering. PCB 30 also supports a cover 32. FIG. 1 depicts the display as momentarily depicting an entire heart symbol.

Before mounting LED matrix 21, pin 31 is opened, wrapped around PCB 30, and closed, so that its head and coil are partly retained by two slots in PCB 30. The openable side of safety pin 31 is to the rear of the ornament. The safety pin is completely retained once LED matrix 21 is mounted in front of it.

Figure 4:
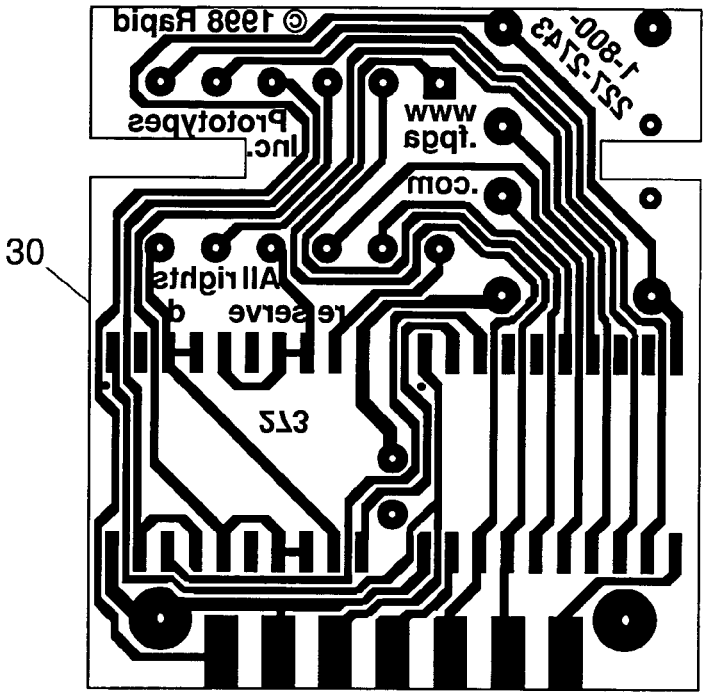
FIG. 4 is a printed circuit layout of the embodiment of FIG. 1.
Figure 5:
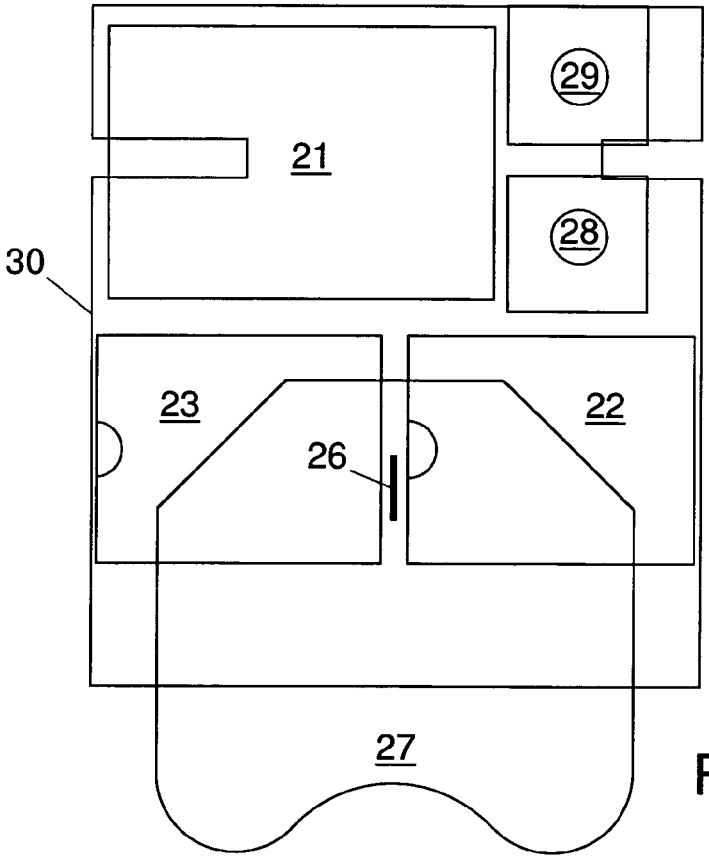
FIG. 5 is a component overlay for the printed circuit layout of FIG. 4.

In the embodiment shown in the figures, PCB 30 is approximately 28 mm wide by 32 mm high and is single-sided, having conductors only on the rear. The pattern of conductors is shown in FIG. 4 as if viewed through the board from the front. Most conductors are 0.254 mm wide with 0.254 mm spacing. FIG. 5 shows the component overlay for both sides of the printed circuit board in the same orientation as FIG. 4.

In the same embodiment, LED matrix 21 is 17.8 mm wide by 12.7 mm high. It has 35 pixels, seven wide by five high, and hence 12 pins. The LED's are preferably of the type and color called high-efficiency red. Although, in our usage, the cathodes of the LED's are commoned into columns, in the manufacturer's terminology this is a cathode row (or anode column) display because it is intended for use seven high and five wide.

Wire link 26 is the negative battery contact. Battery holder 27 is also the positive battery contact. The device can be manufactured without any switches, to further reduce the size, weight, and cost. Battery 25 can simply be removed from holder 27 to turn it off.

Battery 25 can be removed or exchanged for a fresh battery without losing the message, because the message is stored in non-volatile memory. At maximum brightness, the typical battery life is more than eight hours when displaying a message in which about one third of the pixels are active, as is the case with a typical message.

The cover 30 is of red transparent plastic, has holes for the buttons 28 and 29 and a slot for battery access, and clips over the front of the PCB.

The ornament shown in FIGS. 1-5 displays messages consisting of up to 64 characters of text or a 64 pixel wide graphic, or an animation the total of whose frame widths in pixels is up to 64, or any mixture of text characters and graphic columns and animation columns up to a total of 64.

Figure 6:
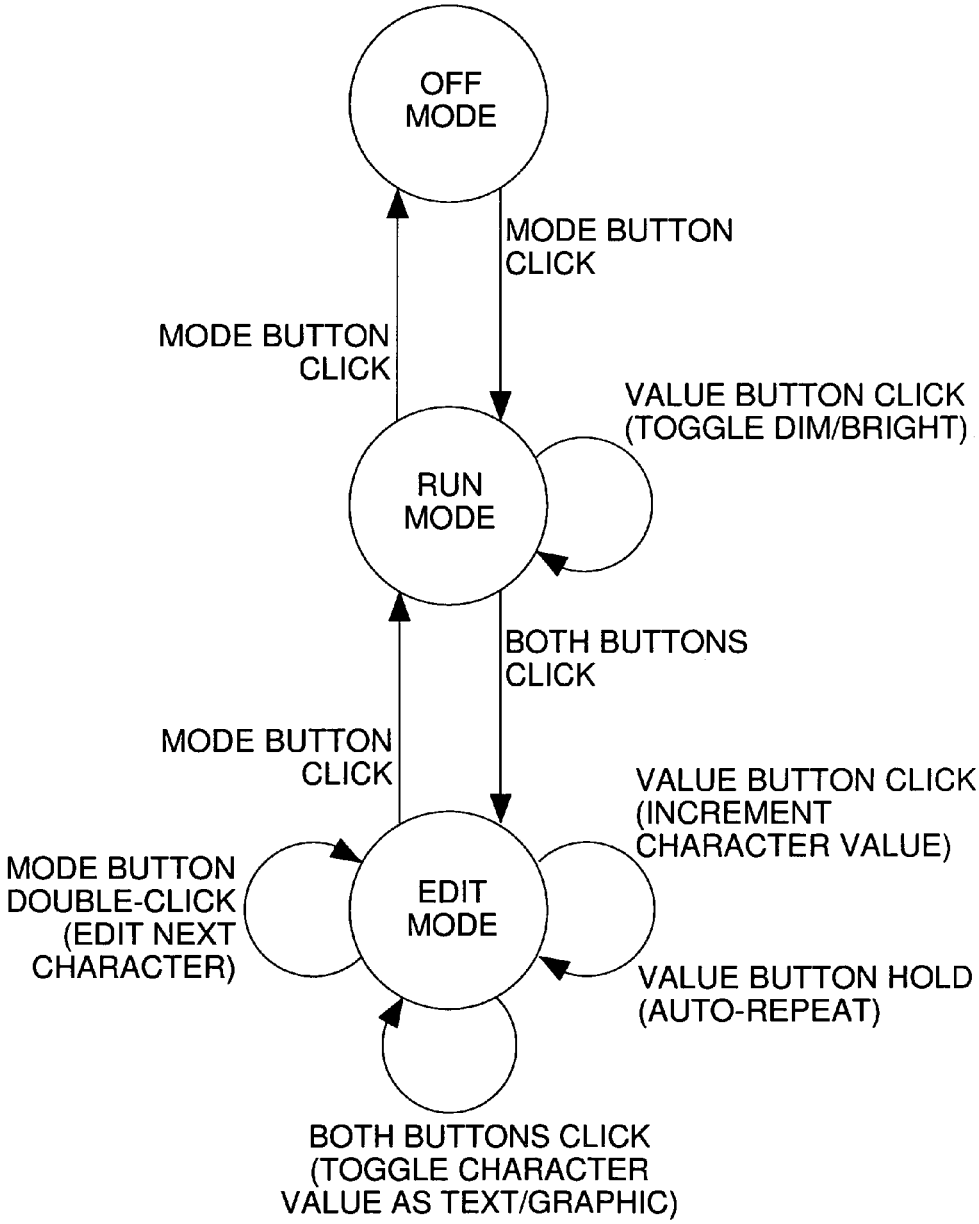
FIG. 6 is a state transition diagram showing the method of operation of the same embodiment.

FIG. 6 is a state transition diagram showing the method of operation using the two programming buttons.

The preferred embodiment begins displaying its message (goes to run mode) as soon as the battery is inserted. For a lower-cost embodiment, no buttons need be fitted to PCB 30. When one button is fitted (mode button 28), the display can be turned off and on (run mode) without removing the battery, for an intermediate-cost solution.

When the second button is also fitted (value button 29), it allows the brightness to be changed and the message to be edited. Clicking (pushing followed immediately by releasing) the value button alone, when in run mode, causes the display brightness to toggle between maximum and dim (a battery saving mode).

In run mode, the message scrolls across the display. Clicking both buttons together freezes the display to show only the current character (the one that was second from the right at the time, including any partial character) and enters edit mode.

In edit mode, each click on value button 29 increments the value of the selected character, cycling around the character set. For convenience the user can, instead of repeatedly clicking the value button, hold it down to cycle quickly around the character set, releasing it when the desired character value is reached.

Figure 7:
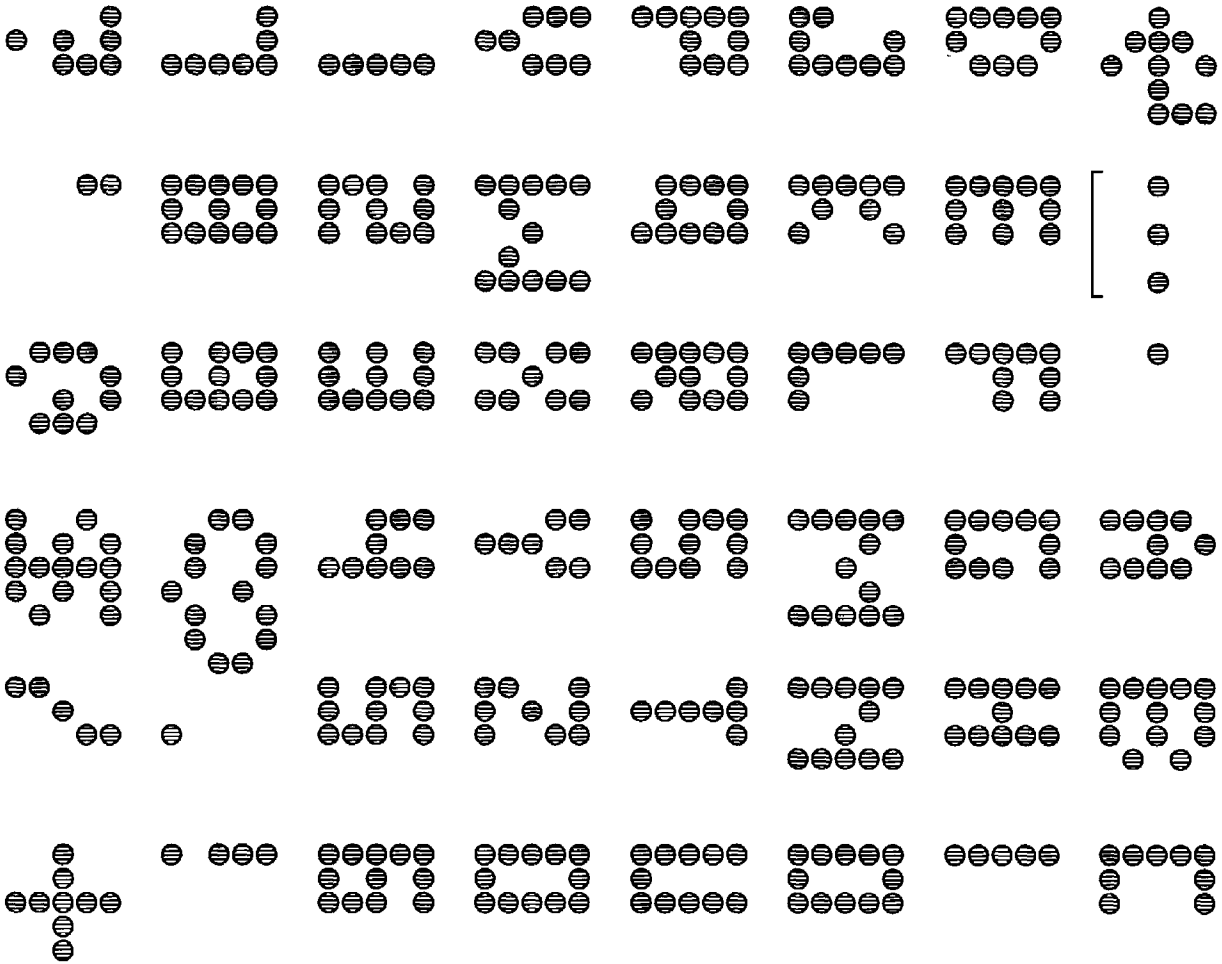
FIG. 7 is a chart showing an example character set for the embodiment of FIGS. 1-6.

There are 48 characters altogether, which include the usual 26 uppercase Roman letters, the 10 Arabic digits, a heart symbol, period, exclamation mark, question mark, apostrophe, "at" symbol, dollar sign, slash, and plus sign. FIG. 7 lists the character set in the order of appearance of the characters when in edit mode. The first three patterns indicate the end-of-message, wide-space, and space characters, respectively. In run mode, these characters are invisible. The space character occupies two columns and the wide-space occupies eight columns.

In edit mode, pushing the mode button returns the device to run mode. However, for convenience, the user can easily move to editing the next character of the message by clicking the mode button twice in quick succession (double-clicking). Because the end-of-message character does not appear in run mode, it cannot be selected by clicking both buttons together in run mode, so the only way to edit it is to stop on an earlier character and double-click to the end-of-message character.

To extend a message beyond the current end-of-message character, one simply edits the end-of-message character to become the next desired character. Following any initial message, the remainder of the message memory (to a total of 64 characters) is filled with end-of-message characters. There is also a virtual end-of-message character in the 65th position, which cannot be edited.

To shorten a message, the user simply edits an existing character to change it to an end-of-message character. Any characters following such a new end-of-message character are not affected and may be revealed again by changing the new end-of-message character back to any other character. This can be used to store "secret" messages.

The device of FIGS. 1-5 can be used to create graphics and animations. In edit mode, pushing both buttons together toggles between editing of characters and editing of graphic (including animation) columns.

Figure 13:
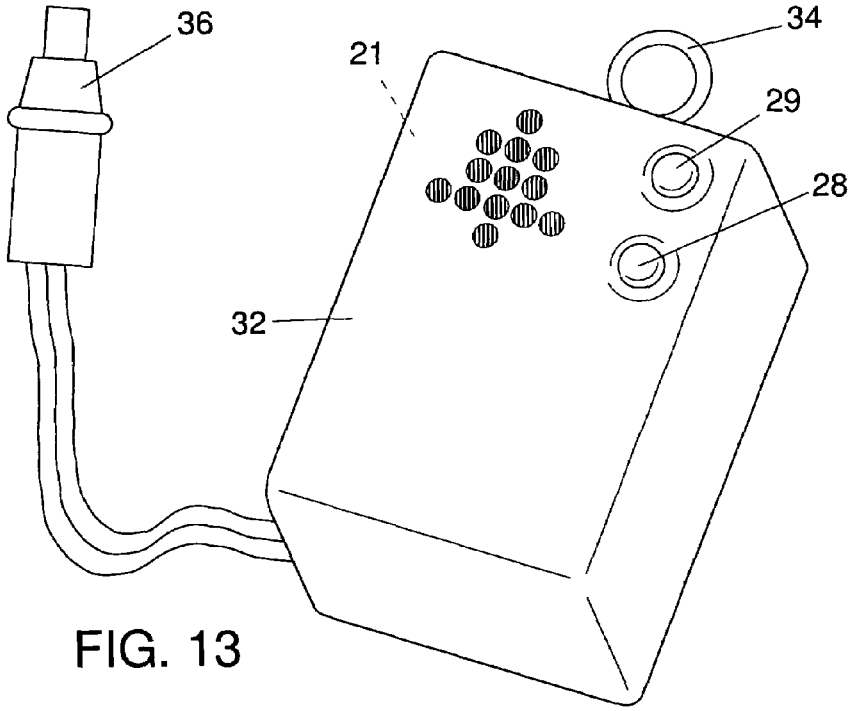
FIG. 13 is a front perspective view of a first alternative embodiment of the invention.
Figure 14:
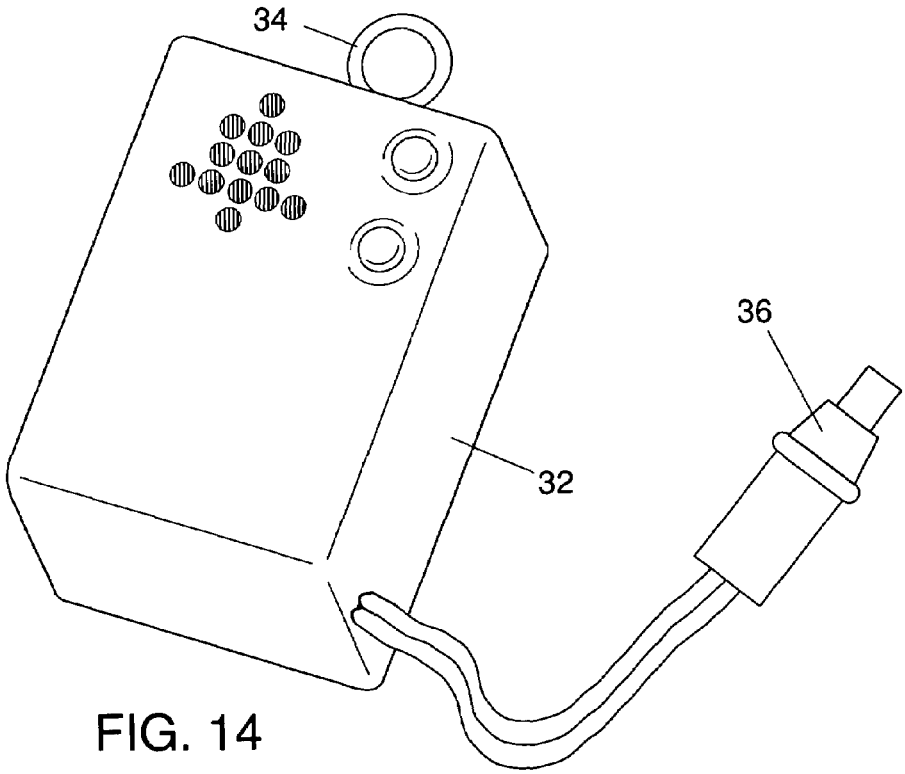
FIG. 14 is a rear perspective view of the alternative embodiment of FIG. 13.

The user can create an arbitrary image by considering the image as a horizontal sequence of single-column "graphics characters" with no gaps between them. These "graphics characters" are simply the 32 possible patterns into which a column of five pixels may be arranged. FIGS. 13 and 14 show a Christmas tree graphic composed of five columns.

In edit mode, the current character, including graphics columns, is displayed at the left side of the display. To avoid confusion, in the preferred embodiment, the top right pixel of the display is lit to indicate that the user is editing a graphics column (including animation columns). When edit mode is first entered for an existing "character," the appropriate editing mode (text or graphics) will automatically be chosen.

The device can also be used to create or edit an animation. The 32 possible column patterns appear twice, for a total of 64; once for use in scrolling graphics and once for use in animation frames.

The difference between an animation column and a (scrolling) graphic column is that an animation column is scrolled into the frame buffer but the frame buffer is not redisplayed, and the next character is fetched without delay. So, for a seven-pixel-wide display, six such animation columns followed by a single graphics column establishes a frame of animation that will only be displayed after the seventh column has scrolled into the buffer. A succession of such frames creates an animation whose frame rate is the same as the pixel-per-second scroll rate (typically 10 Hz).

The two types of graphic columns are distinguished in edit mode by lighting the top pixel second from the right of the display for animation columns only. This is in addition to the top right pixel, which remains lit for both graphics and animation columns. When editing graphics, the value button will cycle around these 64 possible column patterns instead of the 48 preprogrammed text character glyphs.

In addition to "secret" messages as mentioned above, a message can be displayed "in code" by first entering each character as text and then, while still in edit mode, clicking both buttons to change it to the corresponding graphic or animation column. Viewing the binary representation of a character as a sequence of pixels also has educational value in teaching the idea of binary coding. On returning to edit mode and clicking both buttons again, the original text character is restored.

Figure 8:
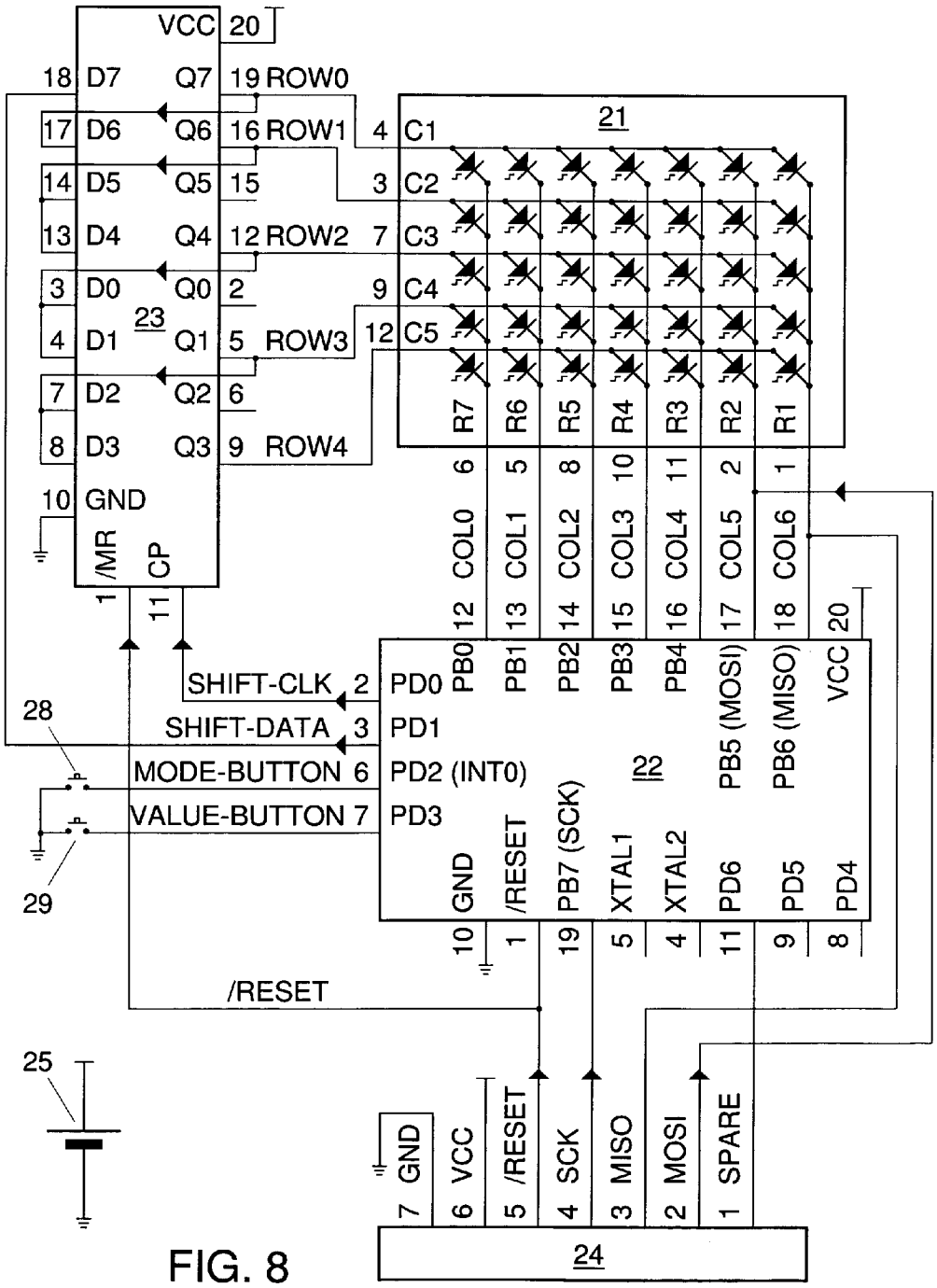
FIG. 8 is an electronic schematic diagram of the same embodiment.

FIG. 8 is an electronic schematic diagram of the embodiment of the wearable illuminated ornament discussed above.

It is expected that LED matrix 21 will be the most expensive single component of the disclosed device. For minimum cost, therefore, a 5×7 display is shown in FIG. 8 as being turned on its side. To use such a display, a five-pixel-high font of variable-width characters should be used.

In such a character set, most characters are three pixels wide with a two-pixel gap separating them. To display an average character, therefore, requires three pixels, but the spacing between starting edges of adjacent characters is most likely five pixels. The seven-pixel-wide LED matrix 21 of this embodiment can show one average-width character, the following gap, and two pixels of the following character, at a single time. In other words, the display shows more than one character and less than two characters at once, most of the time.

MCU 22 can be implemented, in a preferred embodiment, using an AT90S1200A-4SC from Atmel, wired as shown in FIG. 8. That device costs little and requires few additional components. Its specifications state that it can operate with as little as 2.7V of electric potential, but samples tested operated down to 1.7V. It has a power-down mode where it consumes less than one microamp of current. It has 64 bytes of EEPROM in which 30 the message can be stored and 512 words (instructions) of flash ROM in which the program can be stored. Almost half of this space is taken up by the character generator. It has only 32 bytes of SRAM, used as registers. It has programmable internal pull-ups on.its inputs. It can operate without a crystal using an internal RC oscillator that runs at approximately 250 kHz, depending on battery voltage. The "A" suffix on the part number specifies a part with the RC oscillator enabled.

Although MCU 22 has enough I/O pins (15) to drive both the rows and the columns of LED matrix 21 (as well as reading the two buttons 28 and 29), it does not have sufficient current sourcing capability at the desired battery voltage (2.0V to 3.0V). To accommodate that function, a 74AC273 device in a SOIC package can be used for octal D flip-flop 23 to drive the five rows (LED anodes), while MCU 22 drives the seven columns (cathodes).

Octal D flip-flop 23 is wired, as shown in FIG. 8, as a shift register, allowing the rows to be controlled with only two outputs of MCU 22, those labeled SHIFT-CLK and SHIFT-DATA on FIG. 8. This simplifies the layout of PCB 30 and leaves the possibility of switching to a display matrix 21 that is larger, up to 11×8, with no additional hardware apart from the display itself and the extra tracks on PCB 30.

Note that the MOSI and MISO pins (see FIG. 8) of MCU 22 do double duty. In operating mode, they drive the fifth and sixth columns of LED matrix 21 (pulling down for "on"), but in programming mode, they are an input and output, respectively, on programming connector 24. Therefore, it is important to ensure that, in programming mode, none of the rows of LED matrix 21 are pulled up. The external device doing the programming (not shown) through programming connector 24 will not attempt to drive any pins on MCU 22 unless it is holding the /RESET pin of MCU 22 low (active). So the /MR (active low master reset) pin of octal D flip-flop 23 is wired to the /RESET pin of MCU 22 so it is also pulled low by any external programming device. The /RESET pin of MCU 22 has a weak internal pull-up, which also pulls up the /MR input pin of flip-flop 23 when an external programming device is not connected to programming connector 24.

The maximum quiescent current of octal D flip-flop 23 is eight microamps, but this only applies if all inputs are near VCC or GND. If inputs are allowed to float, the quiescent current can increase dramatically due to simultaneous conduction of N and P channel MOSFET's in the input stages. So unused inputs are wired to nearby outputs. Wiring them to VCC or GND would have increased the complexity and size of the PCB layout.

The voltage-current characteristic of the high-efficiency (HE) red LED's is such that, with the low battery voltage, the on-resistance of the output MOSFET's is sufficient to limit the current to safe levels, and no external current limiting resistors are required.

LED matrix 21 is multiplexed so that at most one LED is on at a time. Matrix 21 is scanned in a sideways raster, first down column 0 (from row 0 to row 4), then down column 1, etc. A single complete pass over the matrix is called a field. The field rate is a software parameter but is typically 40 to 80 Hz.

The same image (a frame) is presented several times (fields) before moving on. The frame rate, which defines the rate of scrolling, is typically 10 Hz. If a LED is to remain dark, the MCU must wait for the same time as it does for a lit LED, so the scroll rate does not vary with the number of lit LED's in a frame.

To dim the display, MCU 22 waits between turning off one LED and lighting the next and shortens the on-time to compensate.

When fitted, mode button 28 is the off/run button. In response to an "off" push of this button, MCU 22 executes a SLEEP instruction to enter power-down mode. An external interrupt (or reset) is required to come out of power-down mode. Therefore, mode button 28 must be connected to PD2 (INT0), because this is the only external interrupt input on the AT90S1200 used for MCU 22.

Value button 29 is connected to the PD3 input, because this is an interrupt input (INT1) on another Atmel circuit called the AT90S2313, a pin- and-software compatible version of the AT90S1200 that might be used in an alternative embodiment for MCU 22. The two buttons connect their inputs to GND when pressed and otherwise rely on pull-ups internal to the MCU.

In the preferred embodiment, battery 25 is a CR2032, which is a three-volt lithium-manganese dioxide cell, selected for its low price, low profile, high energy density, moderate discharge rate, and ready availability.

As noted above, both the control software and the message can be erased and reprogrammed via programming connector 24. FIG. 1 illustrates how, in the preferred embodiment, LED matrix 21, battery 25, and the control circuit (consisting of PCB 30, MCU 22, and flip-flop IC 23) are all integrally housed with each other by cover 32. Due to the compactness of this integral housing, for programming via connector 24 in the disclosed embodiment, battery 25 must be removed to allow the connector to plug into the optional seven-way edge socket forming connector 24, shown in FIG. 3. Battery holder 27 ensures correct alignment of the external programming device with edge socket 24.

During programming, 5V is supplied between VCC and GND from the external programming device via an optional 220-ohm current-limiting resistor that is part of the external programming device. This is to protect the LED's in matrix 21, and the outputs driving them, from an over-current condition, although the few samples tested have survived without it. The edge finger of connector 24 marked SPARE on FIG. 8 is not used.

A suitable programming interface circuit to connect programming connector 24 to a personal computer, and suitable personal computer software to perform the programming operations, are available from Atmel. As of the filing date, the software and instructions on how to make a suitable programming interface circuit are available free of charge from Atmel's public World Wide Web site at http://www.atmel.com and are hereby incorporated by reference.

FIG. 9A, continued in FIG. 9B, shows the control software for MCU 22 in Intel hex format, consisting of a number of lines beginning with a colon. To make the device described above operational, this program can be typed or scanned into a text file on a personal computer that is running the same operating system as that required to operate Atmel's programmer software. This file can then be used as the source for programming the flash ROM of MCU 22.

Programming the flash ROM only with the file of FIGS. 9A and 9B will result in an empty initial message. To begin with a message consisting of the words "MERRY XMAS" followed by an image of a Christmas tree, followed by an animated exploding star, the text file shown in FIG. 10 can be programmed into the EEPROM of MCU 22.

Readability tests have been conducted, using a number of test subjects observing a display with an adjustable number of pixel columns, to determine the readability of the display, which can be compared to the cost of the display. For purposes of this test, we fixed the number of rows at five and varied the number of pixel columns. All tests were performed with a variable-width character set five pixels tall that had an average character pitch of five pixels, where the term "pitch" is defined as the average distance between leading edges of adjacent characters, which in turn is defined as the width in columns of the average character, weighted by the frequency of usage of each character, plus the inter-character gap (weighted by frequency of usage if variable). In the example embodiment tested, the pitch consisted of three pixels for the average character width and two pixels for the inter-character gap.

Figure 11:
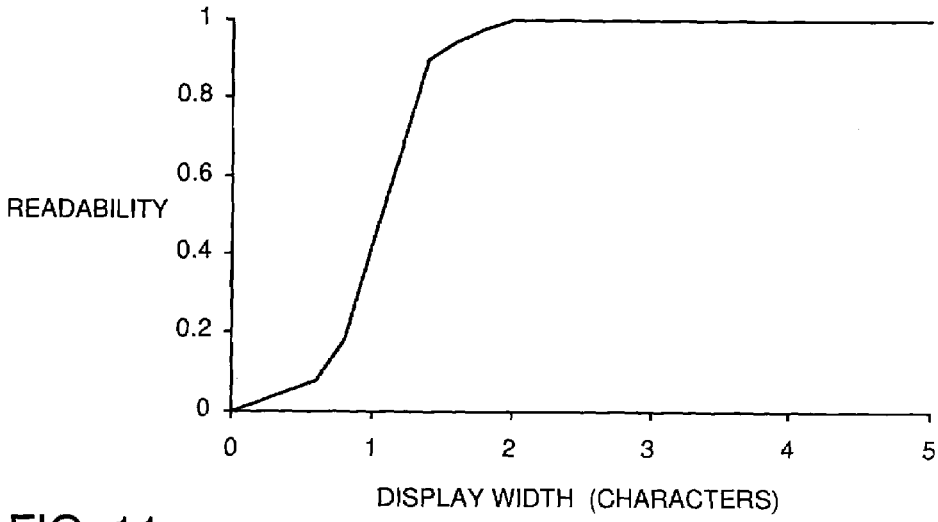
FIG. 11 is a graph showing the readability of the display as a function of display width based on experimental results.

For the purposes of this test, we defined a readability factor as the reciprocal of the number of times a novice viewer must see the message repeat before understanding the message. For example, a readability of 1.0 means the viewer can read the message in a single pass, while a readability of 0.4 means the average viewer must see the message scroll past 2½ times to read it. The results are tabulated below and are shown in the readability curve of FIG. 11, in which the number of columns in the table have been converted to the number of characters at the assumed character pitch.

| | Number of Columns | | | | | |
|---|---|---|---|---|---|---|
| Readability | Three | Four | Five | Six | Seven | Ten |
| Test 1 | 0.0 | 0.2 | 0.5 | 0.5 | 0.8 | 1.0 |
| Test 2 | 0.0 | 0.0 | 0.33 | 0.5 | 0.9 | 1.0 |
| Test 3 | 0.25 | 0.33 | 0.5 | 1.0 | 1.0 | 1.0 |
| Average | 0.08 | 0.18 | 0.44 | 0.66 | 0.9 | 1.0 |

The cost of the device is dominated by the number of display columns. Thus the profitability of the device decreases, quasi-linearly with the number of columns, although almost half of the cost of the seven-column display is attributed to the supporting circuitry. Thus, changing from a seven-column display by adding or subtracting one column will change the relative cost by a factor of $^{0.5}/_{7}$ times the original cost of the seven-column display, and each additional column will cost roughly the same amount.

A useful metric of the utility of a display is the readability factor defined above divided by the relative cost of the display. The relative utility metric is shown in FIG. 12, in which the readability factor divided by the cost of a seven-column display is defined as the unit utility.

Surprisingly, the highest utility embodiment is the one with seven columns wide, recalling that the character pitch is five pixels. At this maximum in the utility function, the display is surprisingly readable, even though less than two full average characters are visible at any given time, yet the display is quite inexpensive.

The peak in the utility curve sits consistently at about 1.5 times the character pitch. This result appears invariant over a wide range of cost models and character pitches. In the embodiment tested, as described above, the cost of the display was about half of the total system cost. The peak utility does not significantly shift when the display cost is varied from 20% to 100% of the system cost. Given that the cost of electronics has decreased faster, historically, than the cost of displays, it can be expected that, over time, the display will represent an increasing fraction of the total system cost. Therefore, it can be expected that the peak utility will remain at or near 1.5 times the character pitch for the foreseeable future.

Figure 12:
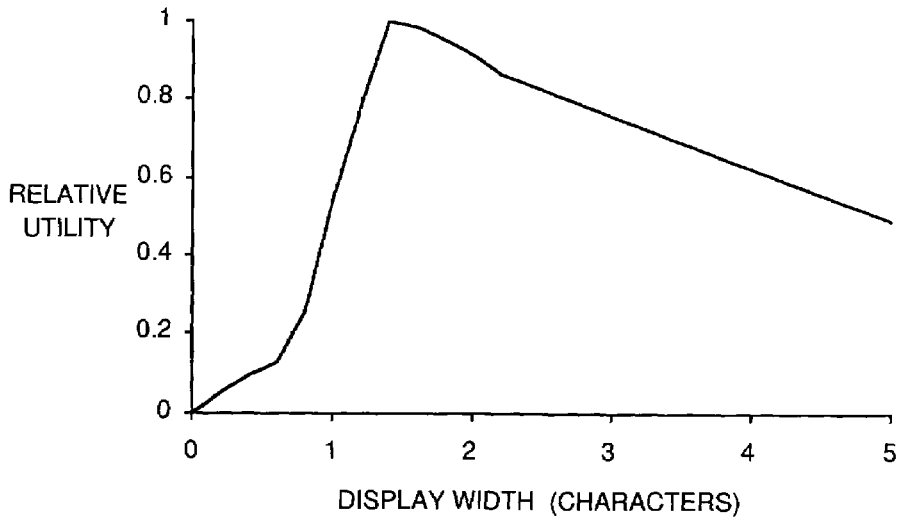
FIG. 12 is a graph showing the results of FIG. 11 when adjusted by the cost of the associated display.

The portion of FIG. 12 with at least half the peak utility ranges from one to five times the character pitch. Choosing a more restricted threshold of 85% of the peak utility results in a display width from 1.1 to 2.0 times the character pitch. And the peak utility remains substantially at 1.5 characters over a wide range of economic cost models.

The disclosed user-programmable illuminated wearable ornament is extremely flexible with regard to the messages it can display while being compact and inexpensive to manufacture. It can be used purely for decoration or to display information such as the wearer's name or contact details, favorite sporting team, political slogans, or humorous messages. It can be used to advertise products or show the cleverness or artistry of the wearer in devising personal graphics or animation.

The message, which may include characters or symbols, arbitrary graphics, and animations, can be changed by the user, not only by using two push-button switches (in embodiments having those), but also by using a programming cable and interface to connect programming connector 24 to a personal computer. With the addition of appropriate software for the personal computer, a user can employ the computer's keyboard, mouse, and display to compose messages conveniently. Programming connector 24 also allows for upgrading of software, either to fix bugs or to take advantage of new techniques, or to program entirely different algorithms, without having to modify or replace the hardware. Custom algorithms can allow larger messages such as more elaborate animations, or a different character set such as Greek or Cyrillic, or other possibilities limited only by the author's imagination and the available space.

While fixed to a person or attached to a Christmas tree or the like, the ornament can be easily read by viewers from a distance of at least six meters, while the ornament itself is only about 30 millimeters in size. On maximum brightness, the display remains readable under normal daytime room lighting, and it can be dimmed by pushing a button, in such a way that the battery life is more than doubled, while still being readable at night.

The ornament weighs less than 20 grams and occupies a volume of less than 20 milliliters.

The device does not require power-wasting resistors to limit the current through the LED's. This also saves on weight, volume, and manufacturing costs.

FIG. 13 shows the front of an ornament that might be used to decorate a Christmas tree. The ornament has a loop 34, which can be used to attach the top of the ornament to the Christmas tree using string or ribbon. FIG. 14 shows the back side of the same ornament. In the particular embodiment shown, a display is visible from either the front or the back of the ornament. The second display could have duplicate circuitry, i.e. its own controller, or it could be driven from the same controller, in which case it would not have its own buttons 28, 29. The ornament of FIGS. 13, 14 can be relatively flat, of similar dimensions to a small gingerbread man. The ornament can be of a shape other than square, such as the shapes discussed just below.

The Christmas tree symbol depicted on the display in FIGS. 13 and 14 can be generated using the program of FIGS. 9A and 9B and the data of FIG. 10.

Figure 15:
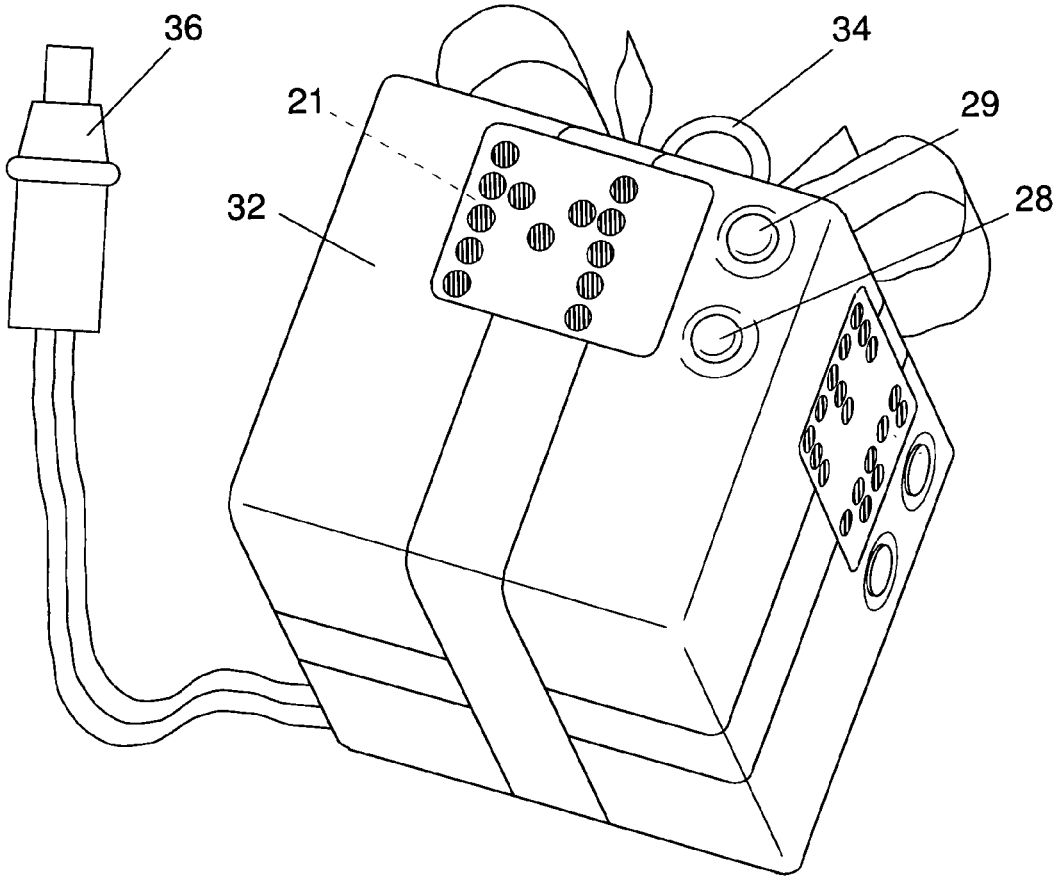
FIG. 15 is a front perspective view of a second alternative embodiment of the invention.

FIG. 15 shows another embodiment of the ornament that might be used to decorate a Christmas tree. This embodiment is more three-dimensional than the embodiment of FIGS. 13, 14. It has a housing 32 that can be of any shape, for example, a Christmas present (as shown), a Christmas tree, a snowman, snow cones, icicles, etc.

Figure 16:
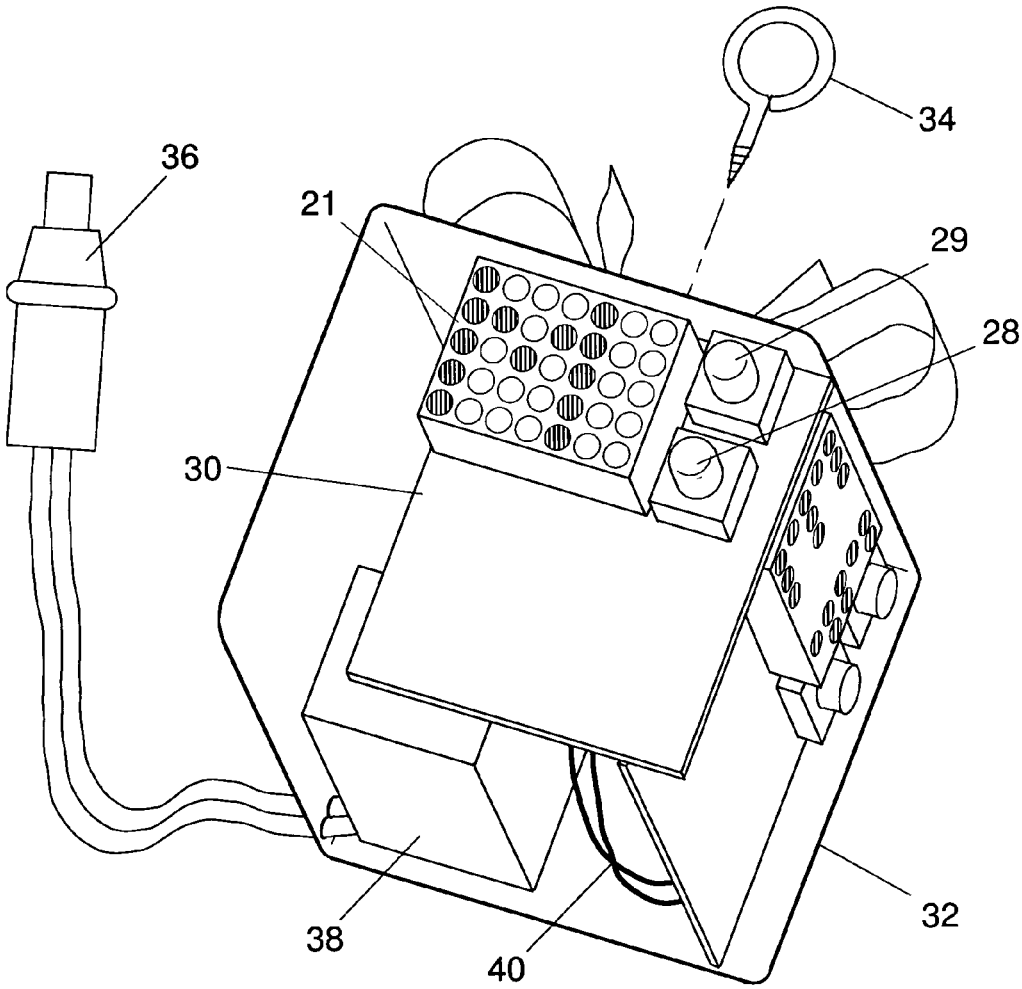
FIG. 16 is a front cutaway and partly exploded view of the alternative embodiment of FIG. 15.

One or more additional display arrays could be connected in parallel with the first to display a message or pattern on more than one side of the ornament. Alternatively more than one complete device could be encapsulated in a single case to achieve this aim, which may be desirable, for example, in a Christmas ornament as shown in FIGS. 13-16. FIG. 16 is cutaway of the embodiment of FIG. 15, to show a power converter 38 and a synchronizing interface 40, consisting of a pair of wires from one graphics controller to another. Synchronizing interface 40 serves to synchronize the displays on each of the four sides, so they can be read in sequence around the Christmas present. It can synchronize any number of displays on any number of sides. In other words, a message can appear to scroll onto the right of one display as it scrolls off the left of an adjacent one. In the example shown in FIG. 15, for example, the "M" of the message "MERRY XMAS" is shown on front LED display 21 at the same time as the "E" and part of the "R"are shown in the side display at the right of FIG. 15. Methods for synchronization of electronic circuits are well known in the art.

In another, more economical alternate embodiment, FIG. 15 can have only a single display on one side of the Christmas present ornament of FIG. 15 (or even on the top).

FIGS. 13-16 each show cover 32, LED display 21, and buttons 28 and 29, which are identical in function to buttons 28 and 29 of FIG. 1. Other alternative embodiments might be designed for special occasions other than Christmas, such as other holidays such as Halloween, Chanukah, or Easter, personal days, such as birthdays or anniversaries, or household ornaments, such as to decorate a kitchen, bar, or bathroom or deliver a message to other family members or to guests.

Although the invention has been described with reference to specific embodiments, many modifications and variations of such embodiments can be made without departing from the innovative concepts disclosed. Thus, the specifics in the above description should not be construed as limiting the scope of the invention but rather as merely providing details of the presently preferred embodiment.

For example, cover 32 can be omitted or it can be made in a different material, shape, or color. It can be attached by clipping, gluing, or heat-staking, when open at the back as in FIG. 1 and 3, or it can be a case that completely encloses the other elements, as in FIGS. 13-16. A single case or cover can be shared by several complete devices, as in FIGS. 13-16. The only requirements are that the case or cover be transparent or non-existent in front of the display and that it allow access to battery 25 or another compact power source, or that it have an external power connector, such as shown in FIGS. 13-16, for connection to an external power source, such as a string of Christmas lights.

PCB 30 can be made with different layouts and in different shapes to suit different applications. It can be made in several pieces wired together. It can be made of thin flexible material. The control circuit can be made without a PCB at all.

Attachment devices other than safety pin 31, such as adhesives, hook-and-loop fasteners, studs, earring pins, bands, chains, cords, clips, or magnets can be used to attach the ornament to a wearer, clothes, accessories, or other objects or surfaces, such as walls, beams, and Christmas trees. An attachment loop 34 is shown in FIGS. 13-16.

The attachment device can be coupled directly to display array 21, which is available commercially as an integrated component having its own plastic casing, or the attachment device can be coupled to display array 21 indirectly via any of the other elements of the ornament, such as PCB 30 in FIGS. 2 and 3 or case/cover 32 in FIGS. 13-16.

Up to an 11×8 LED matrix 21 could be accommodated with no additional hardware apart from the display itself and the extra tracks on PCB 30. For example, two upright 5×7 anode-row displays can be used to form a 10×7 display.

An LED matrix 21 could also be made out of discrete surface mount (SMD) LED's such as the CCL-CRS10xx from Lumex. These discrete LED's are also available in two-color reversible. These could be accommodated with only software changes; however, the current in the reverse direction would be significantly less than the forward current due to the lower current sourcing capability of MCU 22. This might compensate for the higher efficiency of the red LED's compared to the green, but a higher battery voltage would be required to match the brightness of the embodiment described in connection with FIGS. 1-5.

Display arrays formed of elements other than LED's may be used, such as LCD's, whether backlit or not.

The display array need not be arranged rectangularly but might for example be arranged hexagonally such as one in which every second column is offset vertically by a half-pixel from those beside it. The same pulse-width-modulation technique that is used to dim the whole display can be used to dim individual pixels to allow anti-aliasing of interpolated scroll positions.

An alternative MCU 22 is the Atmel AT90S2313, although this circuit does not have the RC oscillator and so would require a crystal or ceramic resonator. Another alternative MCU 22 is the Microchip PIC16LF83, although it would require different software and many changes to the printed circuit layout. Other suitable MCUs can be used in place of these ones.

Octal D flip-flop 23 can be omitted or replaced with any of a number of devices controlled by MCU 22.

The control circuit need not be based on an MCU but could be based on a programmable logic device (PLD).

Figure 17:
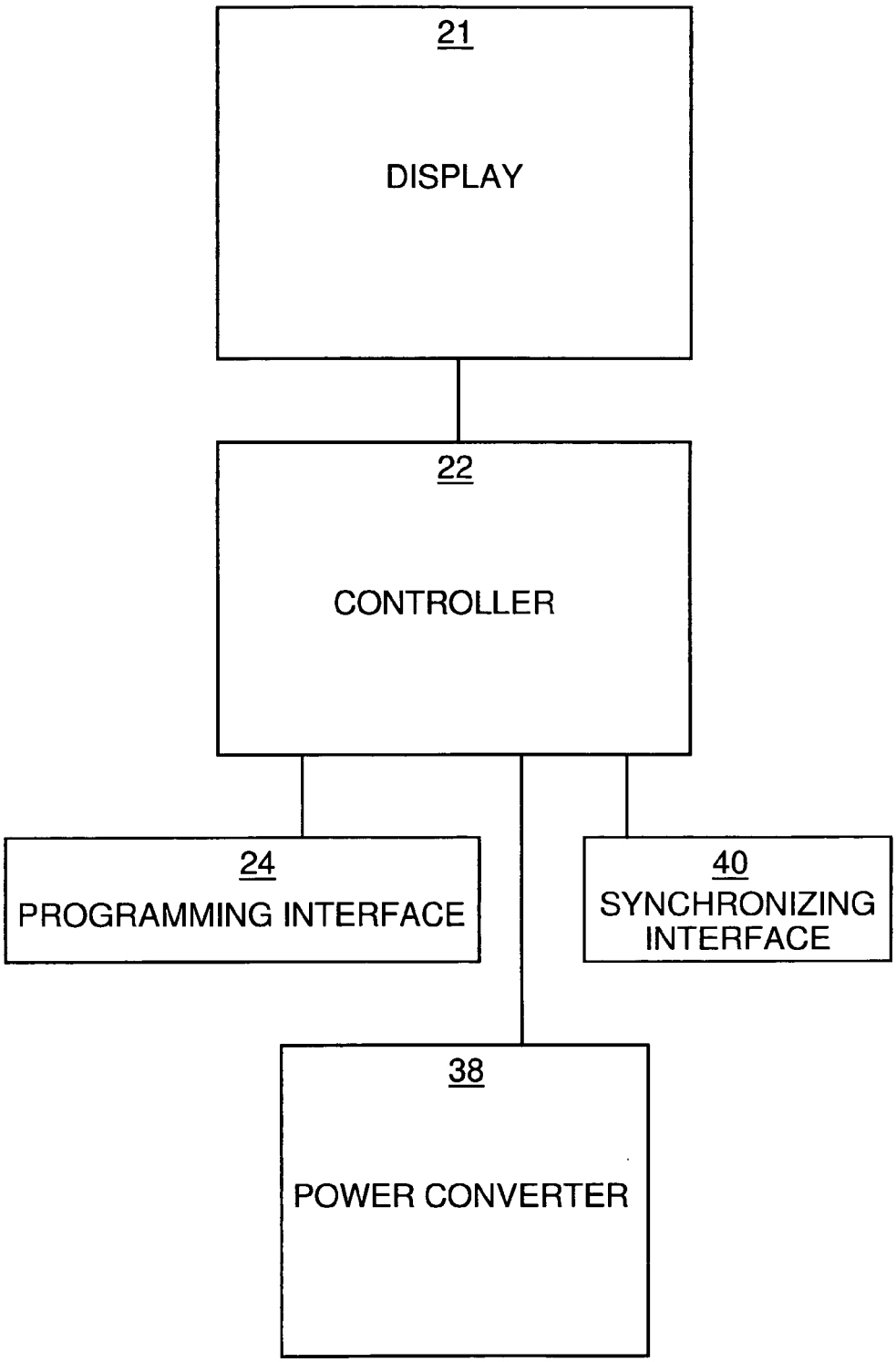
FIG. 17 is a block diagram that relates to the alternative embodiments of FIGS. 13-16.

As mentioned above, a compact power source can (but need not) be replaced by an external power connector. In variations of the embodiments of FIGS. 13-16 that include a compact power source rather than such a connector, each case encloses a compact power source, array of pixel display elements, and graphics controller (see FIG. 17) that are thus integrally housed with each other. The cases illustrated in FIGS. 13-16 are shaped like rectangular prisms, with the case of FIGS. 15-16 being essentially cubical.

Programming connector 24 can be omitted, can have more or fewer fingers, or can be a different type of connector entirely. For example, programming connector 24 can also be replaced by a photodiode or other light-to-electricity transducer. The photodiode can detect sequences of light and dark generated, for example, by a personal computer display. MCU 22 can detect the sequence of light and dark patterns and reduce it to a binary code suitable for programming the device.

Some versions of MCU 22 can be removable from PCB 30 for programming. One or both buttons 28, 29 can be omitted.

Many different physical arrangements and sizes of the components are possible, save only that the display or displays must be visible and thus must face away from the ornament, any buttons must be pushable, and it must be possible to apply the power source and manipulate the attachment device.

Thus the scope of the invention should be determined by the appended claims and their legal equivalents, rather than by the examples given.

Unless specifically noted, it is intended that the words and phrases in the specification and claims be given the ordinary and accustomed meaning to those of ordinary skill in the applicable art or arts. If any other meaning is intended, the specification will specifically state that a word or phrase has a special meaning.

Likewise, any use of the word "function" in the specification, or any claim words that define or imply a function, is not intended to invoke the provisions of 35 U.S.C. § 112, ¶ 6 to define the invention. To the contrary, that paragraph will be considered to define a claimed element of the invention, only if the phrases "means for" or "step for" and a function, without also reciting in that element any structure, material, or act in support of the function, are specifically recited in that claim element.

Thus, it is understood by those skilled in the art that alternative forms and embodiments of the invention can be devised without departing from its spirit and scope. The foregoing and all other such modifications and variations are intended to be included within the spirit and scope of the appended claims.

We claim:

1. An illuminated wearable article comprising:

(a) a regular two-dimensional array of pixel display elements having a front light-emitting side and an opposing back side;

(b) a graphics controller physically fastened and electrically coupled to the array;

(c) wherein the array has a width in pixels that is between one and five times the character pitch of a character set displayed on the array by the graphics controller;

(d) a power source physically fastened and electrically coupled to the graphics controller and the array; and (e) a fastener physically fastened to the back side of the array and suitable for attachment to a human or human clothing.

2. The article of claim 1 wherein the array has a width in pixels that is between 1.1 and 2.0 times the character pitch of a character set displayed on the array by the graphics controller.

3. The article of claim 1 wherein the array has a width in pixels that is approximately 1.5 times the character pitch of a character set displayed on the array by the graphics controller.

4. The article of claim 1 further comprising a common substrate to which the elements (a)-(d) are mounted.

5. The article of claim 4 wherein the substrate is a printed circuit board.

6. The article of claim 1 wherein the fastener has two positions, open and closed.

7. The article of claim 6 wherein the fastener is a safety pin.

8. The article of claim 6 wherein the fastener is configured so that the user cannot remove it from the substrate in either of the two positions.

9. The article of claim 1 wherein the graphics controller is a control circuit configured by a computer program to display a user-selected sequence of patterns on the array.

10. The article of claim 9 wherein the control circuit is programmed to permit the user to select the sequence of patterns from among:

(a) members of an alphanumeric character set;

(b) graphical display elements; and (c) animation frames.

11. The article of claim 9 wherein the brightness of each pixel display element is controlled with pulse-width modulation.

12. The article of claim 9 wherein the control circuit has a non-volatile store for the user-selected sequence of patterns.

13. The article of claim 1 further comprising exactly two buttons physically coupled to the array and electrically coupled to the graphics controller.

14. The article of claim 13 further comprising a programming connector physically coupleable to the array and electrically connectable to the graphics controller.

15. The article of claim 14 wherein those parts of the graphics controller and couplings that conduct current between the power source and the pixel array lack any resistor components.

16. The article of claim 13 wherein those parts of the graphics controller and couplings that conduct current between the power source and the pixel array lack any resistor components.

17. The article of claim 1 further comprising a programming connector physically coupled to the array and electrically connected to the graphics controller.

18. The article of claim 17 wherein the programming connector comprises a light-responsive transducer.

19. The article of claim 17 wherein those parts of the graphics controller and couplings that conduct current between the power source and the pixel array lack any resistor components.

20. The article of claim 1 wherein the pixel display elements are light-emitting diodes.

21. The article of claim 1 wherein the array of pixel display elements, the graphics controller, the power source, and the fastener are mounted on a substrate having a front side and a back side and wherein:

(i) the array of pixel display elements emits light in a direction away from the front side of the substrate, (ii) the graphics controller is electrically connected to the array;

(iii) the substrate further has mounted on it a computer-readable storage medium storing a computer program to cause the control circuit to display a sequence of patterns on the array;

(iv) the power source is electrically connected to the control circuit and the array; and (v) the fastener is coupled to the back side of the substrate.

22. The article of claim 1 further comprising a case, wherein the power source and graphics controller are integrally housed with each other inside the case.

23. The article of claim 1 wherein the article lacks any user-manipulated buttons or switches.

24. The article of claim 23 further comprising a programming connector physically coupleable to the array and electrically connectable to the graphics controller.

25. The article of claim 24 wherein those parts of the graphics controller and couplings that conduct current between the power source and the pixel array lack any resistor components.

26. The article of claim 23 wherein those parts of the graphics controller and couplings that conduct current between the power source and the pixel array lack any resistor components.

27. The article of claim 1 wherein the graphics controller is structured to allow driving the array of pixel display elements to scroll a message across the array.

28. The article of claim 1 wherein the array is composed of emissive pixel display elements.

29. The article of claim 1 wherein the graphics controller and pixel array are structured to permit animated displays.

30. The article of claim 1 wherein the two-dimensional array comprises an array of 7 pixels by 5 pixels.

31. The article of claim 30 further comprising exactly two buttons electrically coupled to the graphics controller.

32. The article of claim 30 further comprising a programming connector physically coupleable to the array and electrically connectable to the graphics controller and wherein the article lacks any user-manipulated buttons or switches.

33. The article of claim 1 wherein those parts of the graphics controller and couplings that conduct current between the power source and the pixel array lack any resistor components.

34. An illuminated wearable article comprising a substrate on which all of the following elements are mounted:

(a) a regular two-dimensional array of pixel display elements having a front light-emitting side and an opposing back side;

(b) a graphics controller physically fastened and electrically coupled to the array;

(c) exactly two buttons electrically coupled to the graphics controller;

(d) a power source physically fastened and electrically coupled to the graphics controller and the array; and (e) a fastener physically fastened to the back side of the array and suitable for attachment to a human or human clothing.

35. The article of claim 34 wherein the graphics controller is a control circuit configured by a computer program to display a user-selected sequence of patterns on the array.

36. The article of claim 34 further comprising a programming connector physically coupleable to the array and electrically connectable to the graphics controller.

37. The article of claim 36 wherein those parts of the graphics controller and couplings that conduct current between the power source and the pixel array lack any resistor components.

38. The article of claim 34 wherein those parts of the graphics controller and couplings that conduct current between the power source and the pixel array lack any resistor components.

39. An illuminated wearable article comprising:

(a) a regular two-dimensional array of pixel display elements having a front light-emitting side and an opposing back side;

(b) a graphics controller physically fastened and electrically coupled to the array;

(c) a programming connector physically coupleable to the array and electrically connectable to the graphics controller;

(d) a removeable and replaceable power source physically fastened and electrically coupled to the graphics controller and the array; and (e) a fastener physically fastened to the back side of the array and suitable for attachment to a human or human clothing;

(f) wherein the article lacks any user-manipulated buttons or switches.

40. The article of claim 39 wherein the programming connector is physically coupleable to the array and electrically connectable to the graphics controller only when the power source is removed, whereby the circuit can be programmed without over-driving the power source.

41. An illuminated wearable article comprising:

(a) a regular two-dimensional array of pixel display elements having a front light-emitting side and an opposing back side;

(b) a graphics controller physically fastened and electrically coupled to the array;

(c) a power source physically fastened and electrically coupled to the graphics controller and the array; and (d) wherein those parts of the graphics controller and couplings that conduct current between the power source and the pixel array lack any resistor components; and (e) a fastener physically fastened to the back side of the array and suitable for attachment to a human or human clothing.

42. The article of claim 41 wherein the article lacks any user-manipulated buttons or switches.

43. The article of claim 42 further comprising a programming connector physically coupleable to the array and electrically connectable to the graphics controller.

44. The article of claim 41 further comprising a programming connector physically coupleable to the array and electrically connectable to the graphics controller.

45. The article of claim 41 wherein the two-dimensional array comprises an array of 7 pixels by 5 pixels.

46. A method of programming a message comprising a sequence of patterns or characters into a wearable ornamental article having at least two buttons and a display, comprising, in order:

(a) when it is desired to alter a first character being displayed in a message being scrolled on the display, activating a first button combination comprised of clicking at least one of the buttons, to toggle from a run mode to an edit mode;

(b) activating a second button combination comprised of clicking at least one of the buttons, while in the edit mode, to switch to the next value from a predetermined ordered character set;

(c) repeating part (b) until a desired first replacement character is shown; and (d) activating a third button combination comprised of clicking at least one of the buttons, while in the edit mode, to toggle from the edit mode to the run mode, thereby causing the replacement of the first character by the first replacement character in the scrolled message being displayed.

47. The method of claim 46 further comprising, after part (c) and before part (d):

(a) activating a fourth button combination comprised of clicking at least one of the buttons, while in the edit mode, to select for alteration a second character being displayed after the first character; and (b) repeating parts (b) and (c) to select a second replacement character;

(c) wherein part (d) also causes replacement of the second character by the second replacement character in the scrolled message being displayed.

48. The method of claim 47 further comprising, after part (a) and before part (d), activating a fifth button combination comprised of clicking at least one of the buttons, while in the edit mode, to change the entire character set to an alternate character set, wherein the character set consists at least primarily of alphanumeric characters and the alternate character set consists of graphic patterns, and wherein:

(a) the first button combination consists of clicking both buttons together while in run mode and the first character is a character that is being substantially displayed;

(b) the second button combination consists of clicking a first of the two buttons while in edit mode;

(c) the third button combination consists of clicking the second of the two buttons while in edit mode;

(d) the fourth button combination consists of double-clicking the second button while in edit mode; and (e) the fifth button combination consists of clicking both buttons simultaneously while in edit mode.

49. The method of claim 46 further comprising, after part (a) and before part (d), activating a fifth button combination comprised of clicking at least one of the buttons, while in the edit mode, to change the entire character set to an alternate character set, wherein the character set consists at least primarily of alphanumeric characters and the alternate character set consists of graphic patterns.

50. An illuminated article useful as an ornament comprising:

(a) a case;

(b) a regular two-dimensional array of pixel display elements supported by the case and having a light-emitting side directed away from the case;

(c) a graphics controller supported by the case and electrically connected to the array;

(d) wherein the array has a width in pixels that is between one and five times the character pitch of a character set displayed on the array by the graphics controller; and (e) a fastener physically coupled to the top of the case, whereby the case is suspended from the fastener.

51. The article of claim 50 wherein the case is shaped like a rectangular prism.

52. The article of claim 50 wherein the array has a width in pixels that is approximately 1.5 times the character pitch of a character set displayed on the array by the graphics controller.

53. The article of claim 50 further comprising a power converter supported by the case, and wherein the case does not support a power source.

54. The article of claim 53 wherein the power converter produces three-volt direct current from a string of Christmas tree lights.

55. The article of claim 50 wherein the array has a width in pixels that is between 1.1 and 2.0 times the character pitch of a character set displayed on the array by the graphics controller.

56. The article of claim 50 further comprising a second regular two-dimensional array of pixel display elements supported by the case and having a light-emitting side directed away from the case and in a different direction from the first array.

57. The article of claim 56 wherein the first and second arrays are controlled by a common set of exactly two buttons supported by the case and electrically coupled to the graphics controller.

58. The article of claim 57 wherein the first and second arrays are controlled by a single graphics controller.

59. The article of claim 57 further comprising a second graphics controller coupled to the second array.

60. The article of claim 57 further comprising a synchronizing interface coupled to the first and second arrays.

61. The article of claim 56 wherein the case is essentially two-sided with the two arrays facing in opposite directions.

62. The article of claim 56 wherein the case is essentially cubical.

63. The article of claim 62 further comprising third and fourth regular two-dimensional array of pixel display elements supported by the case and having a light-emitting side directed away from the case, wherein the four arrays are directed away from the four different sides of the cubical case, and wherein the fastener is affixed to the top of the cubical case.

64. The article of claim 50 wherein the graphics controller is a control circuit configured by a computer program to display a user-selected sequence of patterns on the array.

65. The article of claim 64 wherein the control circuit is programmed to permit the user to select the sequence of patterns from among:

(a) members of an alphanumeric character set;

(b) graphical display elements; and (c) animation frames.

66. The article of claim 65 further comprising exactly two buttons physically coupled to the array and electrically coupled to the graphics controller.

67. The article of claim 64 wherein the brightness of each pixel display element is controlled with pulse-width modulation.

68. The article of claim 50 wherein the fastener is a flexible loop.

69. The article of claim 50 wherein the article occupies a volume of less than 20 milliliters.

70. An illuminated wearable article comprising:

(a) means for displaying a message, the display means having a width in pixels that is between one and two times the character pitch of characters displayed on the display means;

(b) means for driving the display means to repeatedly scroll the user-selected message across the display means;

(c) means for powering the display means, the selection means, and the driving means; and (d) means for attaching the display means, the selection means, the driving means, and the powering means, as a unit, to clothing.

71. The article of claim 70 further comprising means for storing for selection an alphanumeric character set and means for selecting the message as a sequence of patterns from among a set of characters or graphic elements including:

(a) members of an alphanumeric character set;

(b) graphical display elements; and (c) animation frames.

* * * * *